US009458672B2

(12) United States Patent
Jewett

(10) Patent No.: US 9,458,672 B2
(45) Date of Patent: Oct. 4, 2016

(54) METHOD AND DEVICES FOR CENTRALIZING A CASING

(71) Applicant: PORTABLE COMPOSITE STRUCTURES, INC., Irvine, CA (US)

(72) Inventor: Scott E. Jewett, Irvine, CA (US)

(73) Assignee: PORTABLE COMPOSITE STRUCTURES, INC., Irvine, CA (US)

( * ) Notice: Subject to any disclaimer, the term of this patent is extended or adjusted under 35 U.S.C. 154(b) by 388 days.

(21) Appl. No.: 14/204,877

(22) Filed: Mar. 11, 2014

(65) Prior Publication Data

US 2014/0251639 A1 Sep. 11, 2014

Related U.S. Application Data

(60) Provisional application No. 61/775,933, filed on Mar. 11, 2013.

(51) Int. Cl.
*E21B 17/10* (2006.01)
*E21B 7/20* (2006.01)

(52) U.S. Cl.
CPC ..... *E21B 7/20* (2013.01); *E21B 17/1014* (2013.01); *E21B 17/1078* (2013.01)

(58) Field of Classification Search
CPC ..... E21B 17/10; E21B 17/1014; E21B 17/1035; E21B 7/20; E21B 7/061; E21B 17/1078
See application file for complete search history.

(56) References Cited

U.S. PATENT DOCUMENTS

| | | | | |
|---|---|---|---|---|
| 2,654,435 | A * | 10/1953 | Oliver | E21B 21/10 166/237 |
| 3,746,092 | A | 7/1973 | Land | |
| 4,776,397 | A | 10/1988 | Akkerman | |
| 5,379,838 | A | 1/1995 | Wilson et al. | |
| 6,457,519 | B1 | 10/2002 | Buytaert | |
| 7,140,431 | B2 | 11/2006 | Betts | |
| 7,857,063 | B2 | 12/2010 | Thornton | |
| 8,235,106 | B2 | 8/2012 | Fox et al. | |
| 8,360,161 | B2 | 1/2013 | Buytaert et al. | |
| 2012/0279725 | A1 | 11/2012 | O'Connor | |
| 2013/0087334 | A1 | 4/2013 | Buytaert et al. | |

* cited by examiner

*Primary Examiner* — Brad Harcourt
(74) *Attorney, Agent, or Firm* — Russo & Duckworth, LLP; David G. Duckworth

(57) ABSTRACT

New apparatus and methods are provided for positioning and attaching centralizers to the inside sidewalls of a wellbore. One or more centralizers are maintained in the interior of a pipe that is transported downhole into a well for deployment. Preferably, the pipe is also the wellbore's casing and the centralizers are deposited in a top-down manner as the casing travels downhole. The centralizers of the present invention are constructed to have an at least partially circular structure with a central hole. The preferred centralizer has an expanding circular structure wherein the diameter of the centralizer is substantially uniform so as to form an annular construction. Once deployed, the annular centralizer expands to engage the wellbore sidewall with the central hole expanded for passage of the well casing.

9 Claims, 7 Drawing Sheets

METHOD AND DEVICES FOR CENTRALIZING A CASING

RELATED APPLICATIONS

The present application is a continuation-in-part of co-pending U.S. Provisional Patent Application Ser. No. 61/775,933 filed on Mar. 11, 2013.

BACKGROUND OF THE INVENTION

The present invention relates to the construction of subterranean wells. More particularly, the present invention relates to methods and constructions for centering a casing within a well, particularly an oil or gas well.

A well is any boring through the Earth's surface that is designed to find and acquire liquids or gases. Wells for acquiring oil are termed "oil wells". A well that is designed to produce mainly gas is called a "gas well". Typically, wells are created by drilling a bore, typically 5 inches to 40 inches (12 cm to 1 meter) in diameter, into the earth with a drilling rig that rotates a drill string with an attached bit. After the hole is drilled, sections of steel pipe, commonly referred to as a "casing" and which are slightly smaller in diameter than the borehole, are dropped "downhole" into the bore for obtaining the sought after liquid or gas.

The difference in diameter of the wellbore and the casing creates an annular space. When completing oil and gas wells, it is often important to seal the annular space with cement. This cement is pumped in, often flushing out drilling mud, and allowed to harden to seal the well. To properly seal the well, the casing should be positioned so that it is in the middle or center of the annular space. The casing and cement provides structural integrity to the newly drilled wellbore in addition to isolating potentially dangerous high pressure zones from each other and from the surface. Thus, centralizing a casing inside the annular space is paramount and critical to achieve a reliable seal, and thus good zonal isolation. With the advent of deeper wells and horizontal drilling, centralizing the casing has become more important and more difficult to accomplish.

A traditional method to centralize a casing is to attach centralizers to the casing prior to its insertion into the annular space. Most traditional centralizers have wings or bows that exert force against the inside of the wellbore to keep the casing somewhat centralized. Unfortunately, these centralizers increase the profile of the casing, thereby causing increased resistance and potential snagging during casing installation.

Traditional centralizers are commonly secured at intervals along a casing string to radially offset the casing string from the wall of a borehole in which the casing string is subsequently positioned. The centralizers generally include evenly-spaced ribs that project radially outwardly from the casing string to provide the desired offset. Centralizers ideally center the casing string within the borehole to provide a generally continuous annulus between the casing string and the interior wall of the borehole. This positioning of the casing string within a borehole promotes uniform and continuous distribution of cement slurry around the casing string during the subsequent step of cementing the casing string in a portion of the borehole. Uniform cement slurry distribution results in a cement liner that reinforces the casing string, isolates the casing from corrosive formation fluids, prevents unwanted fluid flow between penetrated geologic formations, and provides axial strength.

A bow-spring centralizer is a common type of centralizer that employs flexible bow-springs as the ribs. Bow-spring centralizers typically include a pair of axially-spaced and generally aligned collars that are coupled by multiple bow-springs. The bow-springs expand outwardly from the axis of the centralizer to engage the borehole sidewall to center a pipe received axially through the generally aligned bores of the collars. Configured in this manner, the bow-springs provide stand-off from the borehole, and flex inwardly as they encounter borehole obstructions, such as tight spots or protrusions into the borehole, as the casing string is installed into the borehole. Elasticity allows the bow-springs to spring back to substantially their original shape after passing an obstruction to maintain the desired stand-off between the casing string and the borehole.

Attempts have been made to develop low-profile, deployable centralizers that can be added to the outside of the casing/pipe. These are designed to reduce friction and snagging due to the fact that the supports or bows are retracted until in their final position. The challenge in developing an effective deployable centralizer is to make it as low profile as possible, actuate deployment upon demand, and to overcome de-centralizing force.

Centralizers are usually assembled at a manufacturing facility and then shipped to the well site for installation on a casing string. The centralizers, or subassemblies thereof, may be assembled by welding or by other means such as displacing a bendable and/or deformable tab or coupon into an aperture to restrain movement of the end of a bow-spring relative to a collar. Other centralizers are assembled into their final configuration by riveting the ends of a bow-spring to a pair of spaced-apart and opposed collars. The partially or fully assembled centralizers may then be shipped in trucks or by other transportation to the well site.

U.S. Pat. No. 6,871,706 discloses a centralizer that requires a step of bending a retaining portion of the collar material into a plurality of aligned openings, each to receive one end of each bow-spring. This requires that the coupling operation be performed in a manufacturing facility using a press. The collars of the prior art centralizer are cut with a large recess adjacent to each set of aligned openings to accommodate passage of the bow-spring that is secured to the interior wall of the collar. The recess substantially decreases the mechanical integrity of the collar due to the removal of a large portion of the collar wall to accommodate the bow-springs. The collars of the casing centralizer disclosed in this patent also require several additional manufacturing steps, including the formation of both internal and external (alternating) upsets in each collar to form the aligned openings for receiving and securing bow-springs, a time-consuming process that further decreases the mechanical integrity of the collar.

U.S. Pat. No. 4,545,436 and Great Britain Patent No. 2242457 both disclose casing centralizers having a plurality of bow-springs which are connected at either end to the first and second collars. As described in U.S. Pat. No. 4,545,436, the bow-springs are connected to the collars using rivets or by welding. Conversely, in Great Britain Patent No. 2242457, the bow-springs are connected using nuts and bolts.

Improved centralizers and methods continue to be sought, particularly in view of the limitations of the prior art and the need for better and stronger centralizers. Considerations for the development of new centralizers and new methods of assembling the centralizers include manufacturing costs, shipping costs, the costs associated with installing the centralizers onto pipe strings and the ease of running the pipe string into the well.

SUMMARY OF THE INVENTION

Briefly, in accordance with the invention, improved apparatus and methods for centralizing a well casing are provided. Current traditional methods of centralizing a casing include the attachments of centralizers to the casing exterior prior to the casing being deposited downhole into a well. Contrary to this traditional method, the present apparatus and methods provide for positioning and attaching the centralizers to the inside sidewalls of the wellbore prior to the casing traveling downhole past the centralizer placement in the wellbore.

The centralizers are maintained in the interior of a pipe that is transported downhole into a well for deployment of one or more centralizers. The pipe has a traditional construction having a cylindrical sidewall, a central conduit, a distal extremity and an opening at the pipe's distal extremity. Preferably, the "pipe" is also the wellbore's casing and the centralizers are deposited in a top-down manner as the pipe/casing is communicated downhole during completion of the well. However, a pipe, separate from the casing, may be utilized to deploy the centralizers in either a top-down or bottom-up process. Where a separate pipe has been employed to deposit the centralizers (either top-down or bottom-up), the pipe is removed from the wellbore once the centralizers are in place and the casing is then made to travel downhole through the center of the centralizers until the casing has reached its desired depth. Because the preferred embodiment employs use of a casing to deposit the centralizers, the following description will primarily refer to the pipe which deposits the centralizers in place as "casing", though the invention is not intended to be so limited.

The centralizers of the present invention may be constructed in various forms to have an at least partially circular expandable structure having a central hole. For example, the preferred centralizer has an expanding tubular structure wherein the diameter of the tube is substantially uniform so as to be circular and form an annular construction. This preferred annular centralizer has a pre-expanded diameter sufficiently small so as to fit into the pipe/casing as it freely travels downhole into a wellbore. However, the post-expanded diameter of the annular centralizer is sufficiently large so as to engage and affix to the wellbore sidewalls after it is has been positioned in place.

An alternative centralizer of the present invention has an arcuate shape which is not entirely circular. Like the annular centralizer, the arcuate centralizer has a shape sufficiently small so as to reside within the pipe/casing as it freely travels downhole into a wellbore. However, the arcuate centralizer has a shape having a partially circular construction so as to engage and affix to the cylindrical wellbore sidewall after it is has been positioned in the desired place to centralize the casing. Though an arcuate structure does not have a central hole, the term "hole" is meant to be interpreted broadly to include the concave interior of the arcuate centralizer.

The partially circular (annular or arcuate) centralizers are preferably pre-loaded, in sufficient number, into a magazine that is attached in-line with the casing/pipe string. The magazine is positioned either near or distally beyond the leading tip of the casing/pipe. As the casing/pipe string is inserted into the wellbore, the centralizers are deployed upon demand.

Those skilled in the art can develop methods for deploying the centralizers without undue experimentation. However, a first preferred method and apparatus includes ejecting the annular centralizers at the front end of the casing string. The centralizer will self-deploy, opening to engage the inside diameter of the passageway or wellbore, and provide a central passageway for the casing string to enter.

Alternatively, the centralizer transport mechanism may force the centralizer into the annular space and force it backward over the casing string. As but one example, the centralizer transport mechanism may include a central shaft that extends through the magazine to the magazine's end. The central shaft terminates at a cap having the purpose of closing off the end of the magazine, but also takes a role in ejecting the centralizer into the annular space. When a centralizer is to be deployed, the shaft is pushed forward with a stack of un-deployed centralizers. Once the forward most centralizer is exposed, the shaft is pulled backwards to force the centralizer to expand and deploy. Alternatively, drive gears at the front tip of the casing string may be employed to engage rack gears on the centralizer to eject each centralizer, force its deployment, and then transport it backwards over the casing string. These drive gears could be powered by hydraulics, a small mud motor, or other means.

Still another deployment method and apparatus includes ejecting arcuate centralizes from the side of a magazine or casing section. These arcuate centralizers can be oriented as desired. They can also be radially installed so that they encircle the casing. For example, connectors or connector arms can maintain the arcuate centralizers in position as the casing and casing hole is rotated for the ejection of additional arcuate centralizers Once installed, the centralizers anchor to the inside of the wellbore or larger tube, and form an annular or partially circular shape having a central hole for receipt and passage of the casing. The diameter of the centralizers' central hole is sufficient that it receives the casing without significant frictional resistance while still centralizing the casing to the desired degree. As the casing string travels past the centralizers, the casing string is forced into centralization.

To assure that centralizers are installed where needed, drillers can use traditional imaging techniques or calipers to verify wellbore integrity prior to deployment. The centralizer magazine may incorporate a caliper or sensor system so as to indicate to drillers when the casing is de-centralized enough to warrant deployment of another centralizer, or indicate locations where there might be a void or obstruction.

The centralizers preferably have a low frictional region for receipt and passage of the casing such as by employing ball bearings, rollers, or low coefficient of friction materials for easy casing manipulation. Preferably, the centralizers are configured so that irregularities in the outside diameter of the casing will glide smoothly through the centralized port. This allows for smooth passage of casing joints or other irregularities in the outside surface of the casing.

Anchoring the centralizer to the wellbore sidewall can be accomplished by numerous constructions. One construction includes spring loading the expander so that the centralizer applies pressure to the wellbore interior sidewall. For a more secure connection, cleats may be incorporated into the extremities of the centralizer to grip the wellbore. These cleats may be driven into the wellbore through deployment force induced from a mechanism within the magazine. These cleats may also be driven into the wellbore from the force of the casing being pushed through the central opening. Another preferred embodiment for anchoring the centralizers or wedges is to screw anchors into the wellbore. A drive mechanism within the magazine can rotate a screw-like anchor and drive it into the wellbore.

Thus, it is an object of the invention to provide improved centralizers and methods of installing centralizers downhole in a well.

DETAILED DESCRIPTION OF THE INVENTION

Figure 1:
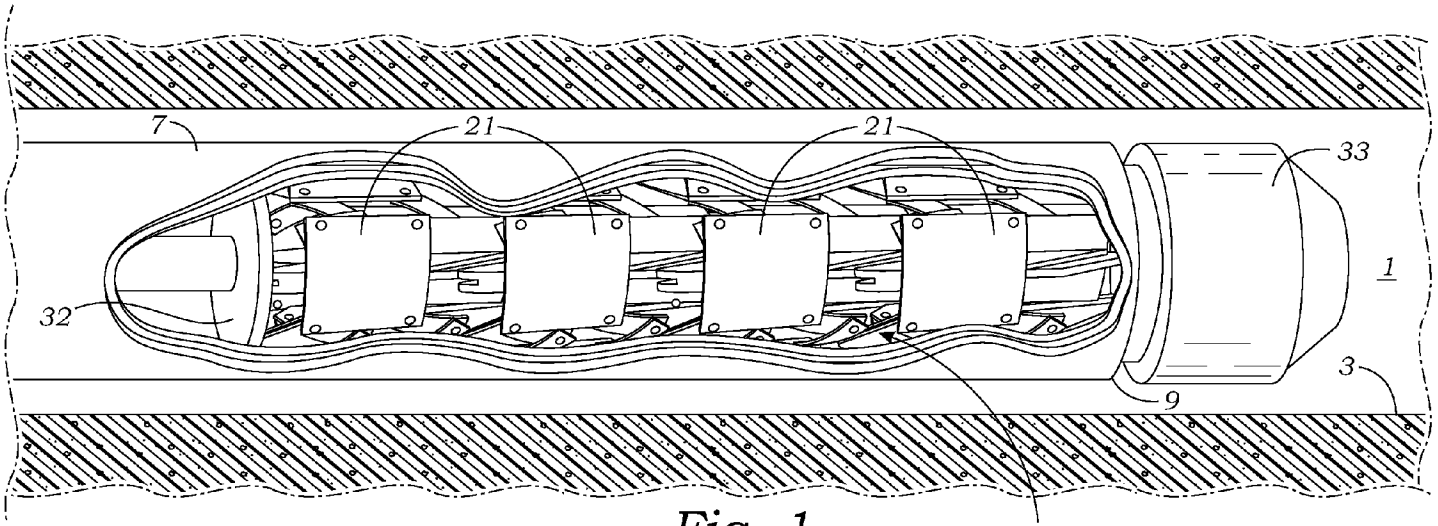
FIG. 1 is a side cut-away view of a wellbore illustrating an annular centralizer within a pipe/casing of the present invention.

With reference to all FIGS. 1-14, the present invention is directed to various apparatus and methods for installing a centralizer 21 wherein the centralizer 21 has been transported to its position within the wellbore 1, but not attached to a casing's exterior. Instead, the centralizer 21 is transported to its desired location within the wellbore from within a pipe's interior and then ejected from the pipe 7. The deployment of the centralizer 21 from the pipe can be determined by various methods known to those skilled in the art, such as by employing a plunger 32 which simply pushes the centralizer from the pipe's distal end 9. However, the ejection of the centralizer 21 can also be effected through a portal 13 formed into the pipe's sidewall, as illustrated in FIGS. 7-12. Preferably, the pipe is the casing used to extract a liquid or gas. However, an initial pipe may be dropped downhole to deploy the centralizers, and then retracted to allow the introduction of the well casing.

As illustrated in FIGS. 1-6, a preferred centralizer 21 has a fully circular shape to provide an annular construction. During installation, a plurality of centralizers 21 are stored within an installation assembly 29 including a magazine 31 and a nose cone 33 constructed to centralize both the installation assembly 29 and the casing 7 while the centralizers 21 are being deployed. Though not shown in the figures, the nose cone 33 may include a caliper having a plurality of fingers which engage the wellbore's sidewall 3 for maintaining the casing and centralizers in proper concentric position. The nose cone 33 may also include sensors, including temperature, pressure and optical sensors for assessing the conditions within the wellbore.

Figure 2:
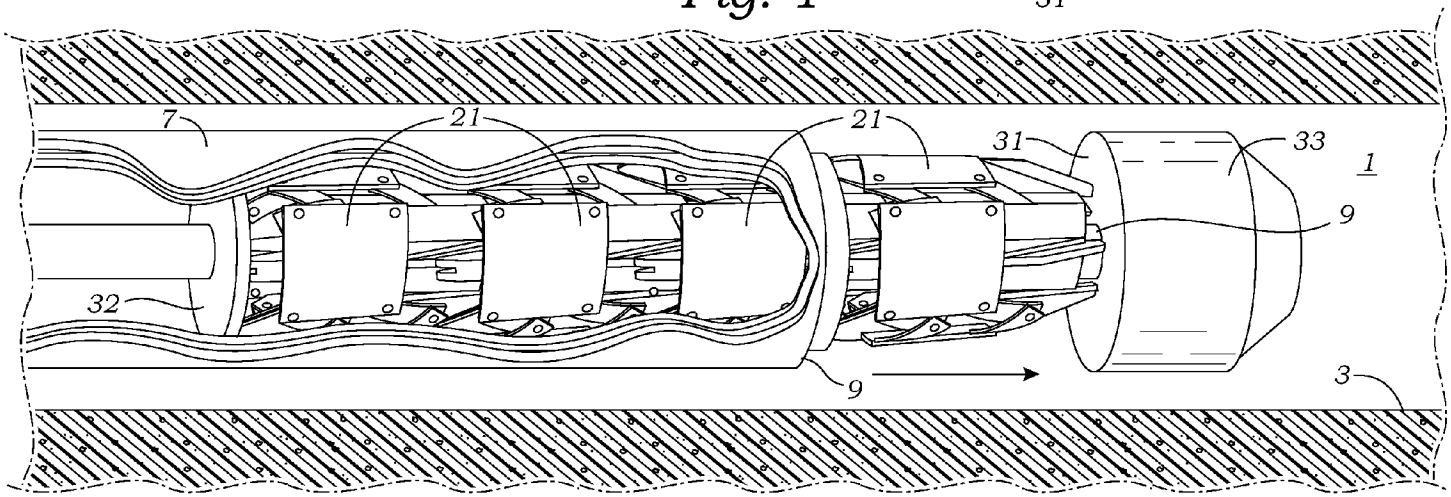
FIG. 2 is a side cut-away view of a wellbore illustrating an annular centralizer within a pipe/casing being deployed, but prior to ejection.
Figure 3:
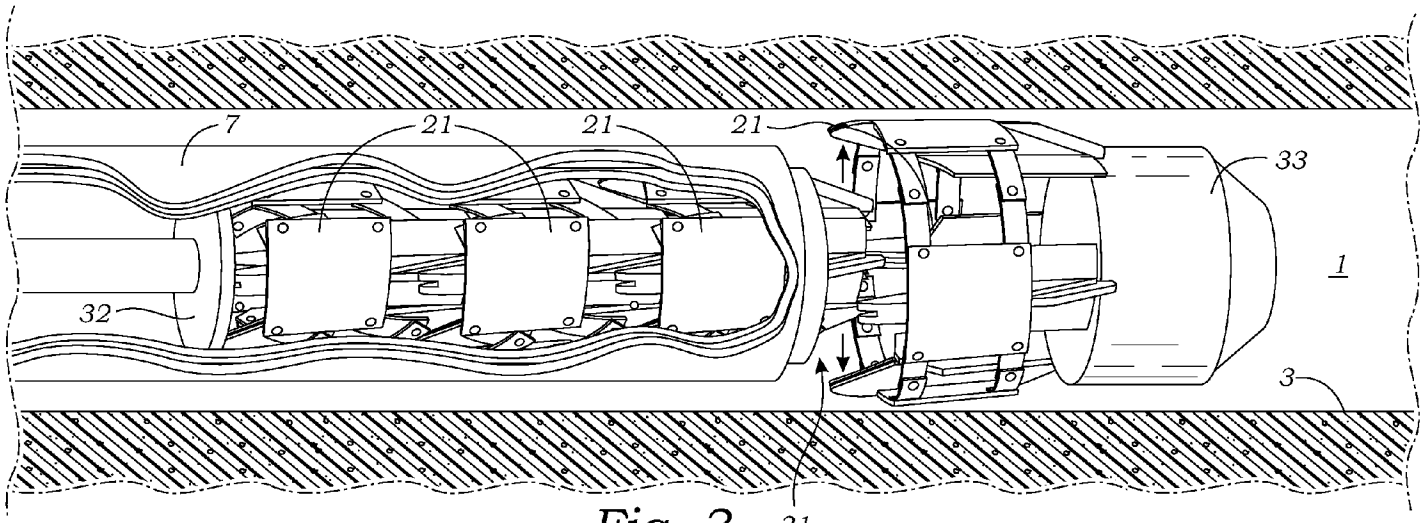
FIG. 3 is a side cut-away view of a wellbore illustrating an annular centralizer within a pipe/casing in the process of being ejected.
Figure 4:
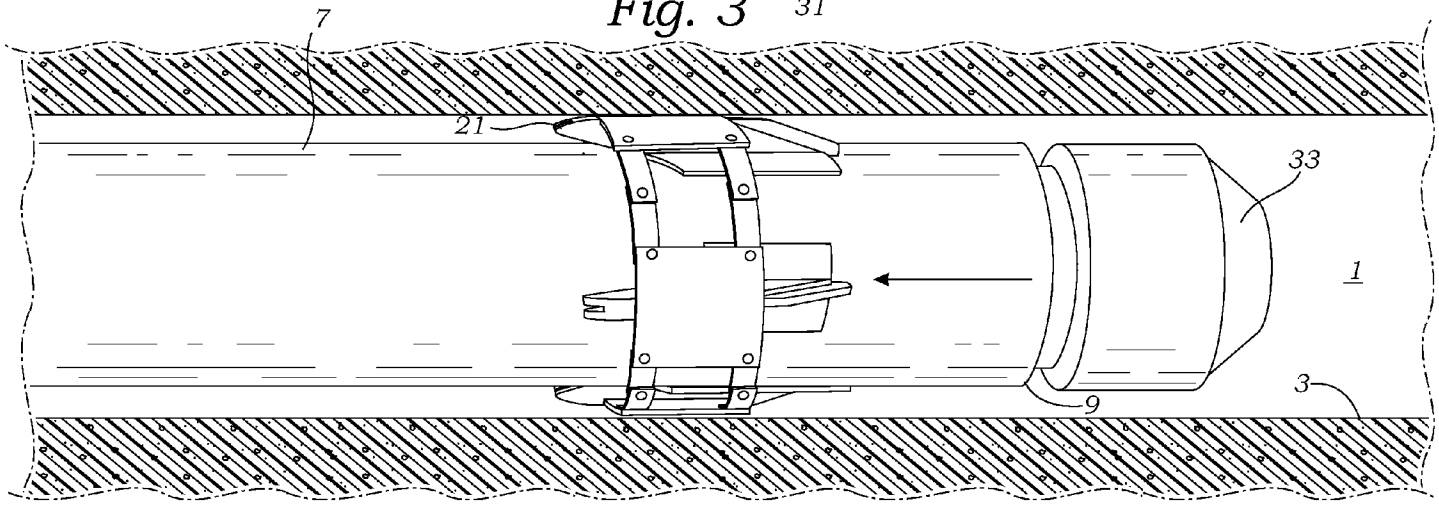
FIG. 4 is a side cut-away view of a wellbore illustrating an annular centralizer within a pipe/casing after it has been fully deployed.

As illustrated in FIG. 1, the installation assembly's magazine 31 can be retracted into the pipe/casing 7 providing a "closed" condition wherein centralizers are maintained within the casing's central bore 11. Meanwhile, FIG. 2 illustrates the magazine 31 projecting from the casing's downhole distal end 9 so as to "open" and release a centralizer 21. Each annular centralizer 21 is expandable, preferably automatically by springs or pneumatic actuators, so as to expand radially after being released from the interior of the pipe/casing. As illustrated in FIG. 2, the centralizer is initially in a closed condition. However, FIG. 3 illustrates that upon release from the magazine 31 from the interior of the pipe/casing, the centralizer 21 expands outwardly so as to engage the wellbore sidewall 3. Of importance, the centralizer 21 has a central hole 23 having a diameter which is larger than the outer diameter of the casing 21 so that the casing is capable of traveling concentrically through the centralizer 21. As illustrated in FIG. 4, once a centralizer 21 has expanded into its operational annular construction, the magazine may be retracted into the casing until the next centralizer is to be deployed. Moreover, as the casing 7 travels downhole, the installed centralizer remains in place, thereby centralizing the casing as the next centralizers 21 are deployed.

Figure 5:
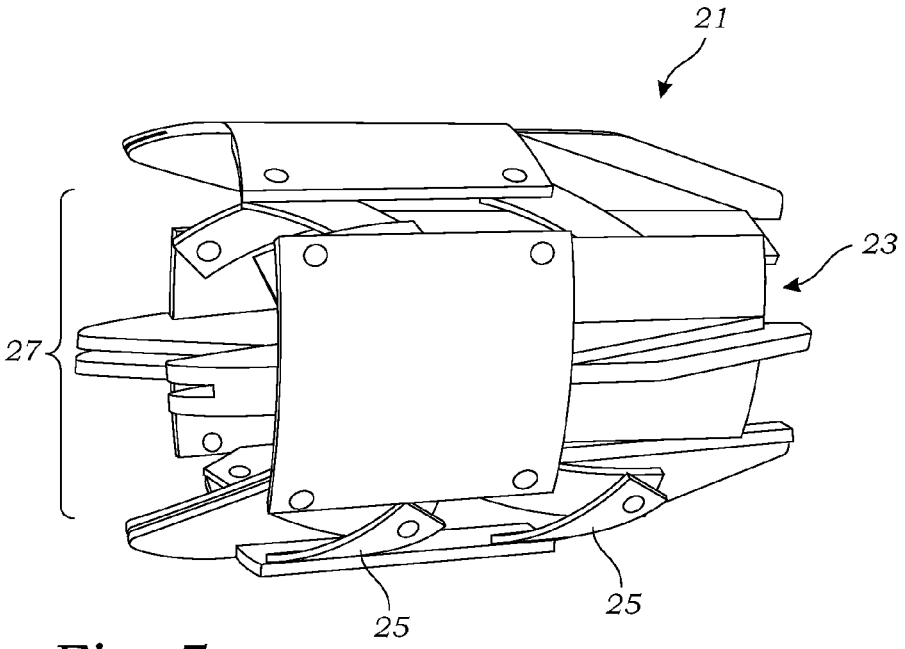
FIG. 5 is a side perspective view illustrating a preferred annular centralizer in a retracted condition.
Figure 6:
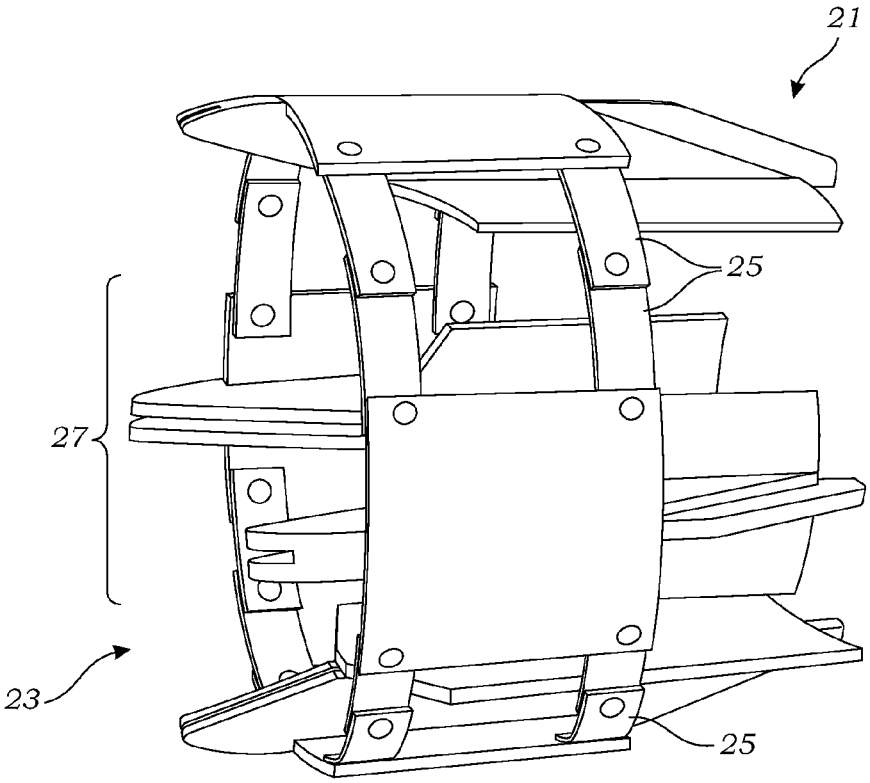
FIG. 6 is a side perspective view illustrating the preferred annular centralizer of FIG. 5 in an expanded condition.

As illustrated in FIG. 5, the annular centralizer 21 is collapsible so as to reside within the central bore of a casing. Moreover, as illustrated in FIG. 6, the centralizer's annular construction is expandable so as to have a greater diameter, and a correspondingly greater central hole 23 once it has been expanded. Furthermore, it is preferred that the centralizer's inlet have tapered leading edges 27 to form a partially conical construction, meaning that the inlet has as great a diameter as possible. This tapered/conical inlet is to prevent interference, and corresponding impedance, of the casing 7 as it enters into the centralizer's central hole 23 and as the casing 7 telescopically travels through the centralizer 21.

Figure 13:
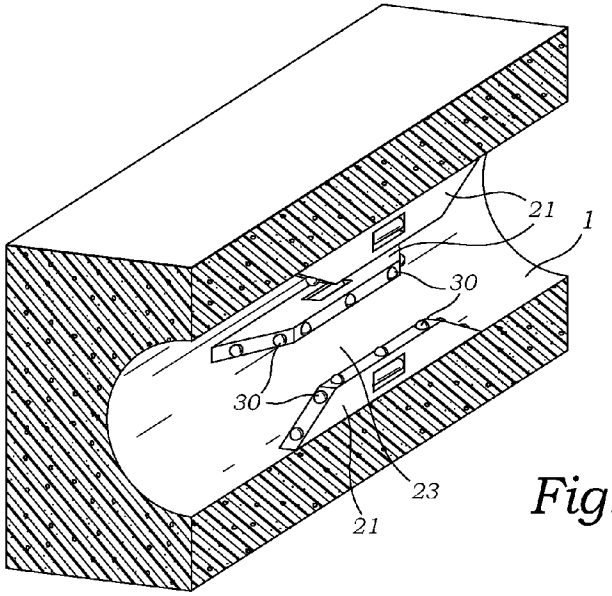
FIG. 13 is a perspective cut-away view of a wellbore illustrating three arcuate centralizers after being deployed wherein the centralizers include roller bearings to reduce friction of a casing as it is deployed.
Figure 14:
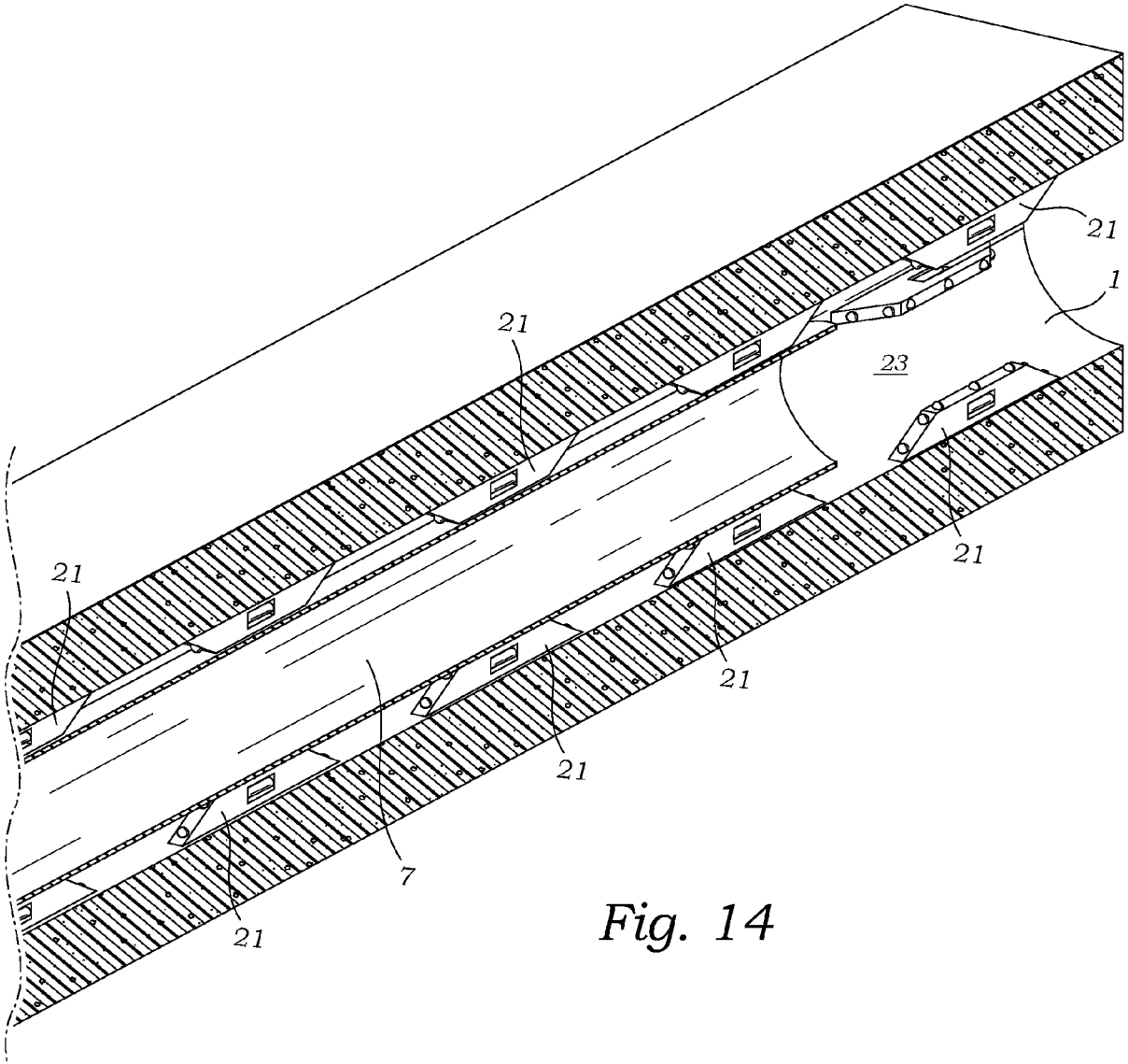
FIG. 14 is a perspective cut-away view of a wellbore illustrating a plurality of arcuate centralizers including roller bearings to reduce friction with a casing as it is deployed.

The mechanism for collapsing and expanding a centralizer of the present invention can employ innumerable constructions as can be determined by those skilled in the art. As illustrated in FIGS. 5 and 6, a preferred construction includes scissor arm constructions 25 in which the arms are hinged so as to expand into a deployed construction. Though not illustrated in FIGS. 5 and 6, preferably the centralizer includes springs or pneumatic actuators or the like for automatically expanding the centralizer when it has been deployed from the casing's central bore. As illustrated in FIGS. 13-14, preferably the centralizer's central hole 23 has ball bearings 30, or another low friction construction, to allow the casing to slide through the centralizer's central hole 23.

Figure 7:
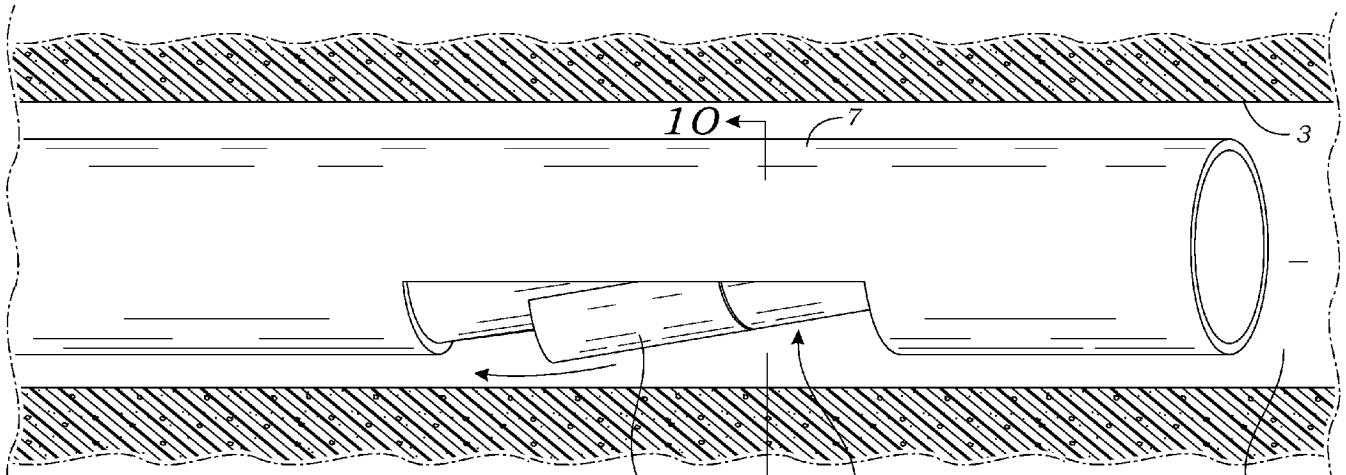
FIG. 7 is a side cut-away view of a wellbore illustrating an arcuate centralizer within a pipe/casing prior to being deployed from a pipe's sidewall opening.
Figure 8:
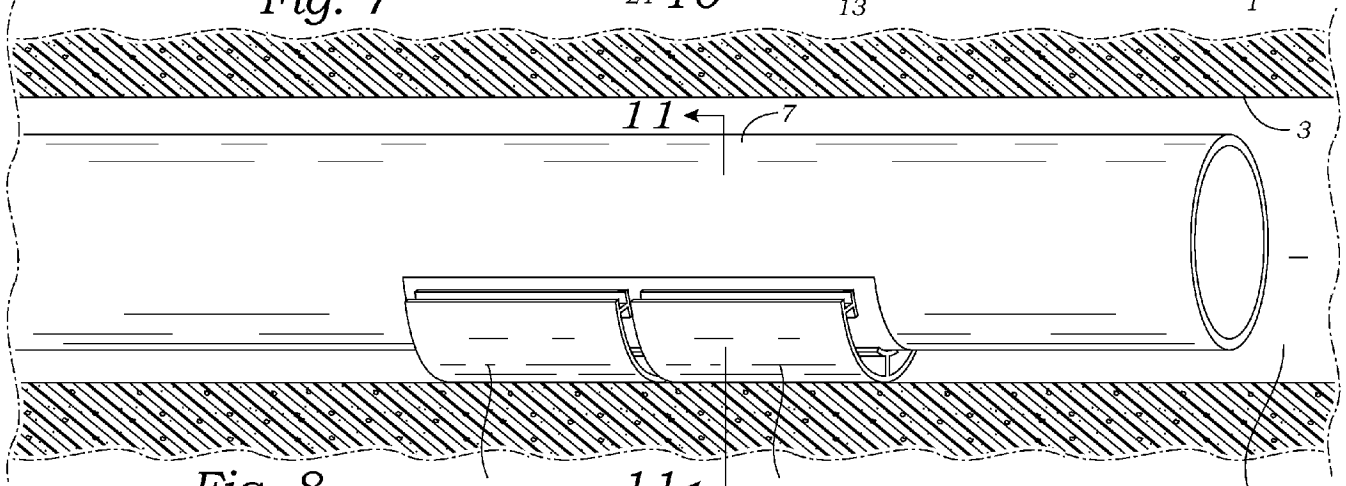
FIG. 8 is a side cut-away view of a wellbore illustrating an arcuate centralizer in the process of being deployed from a pipe's sidewall opening.
Figure 9:
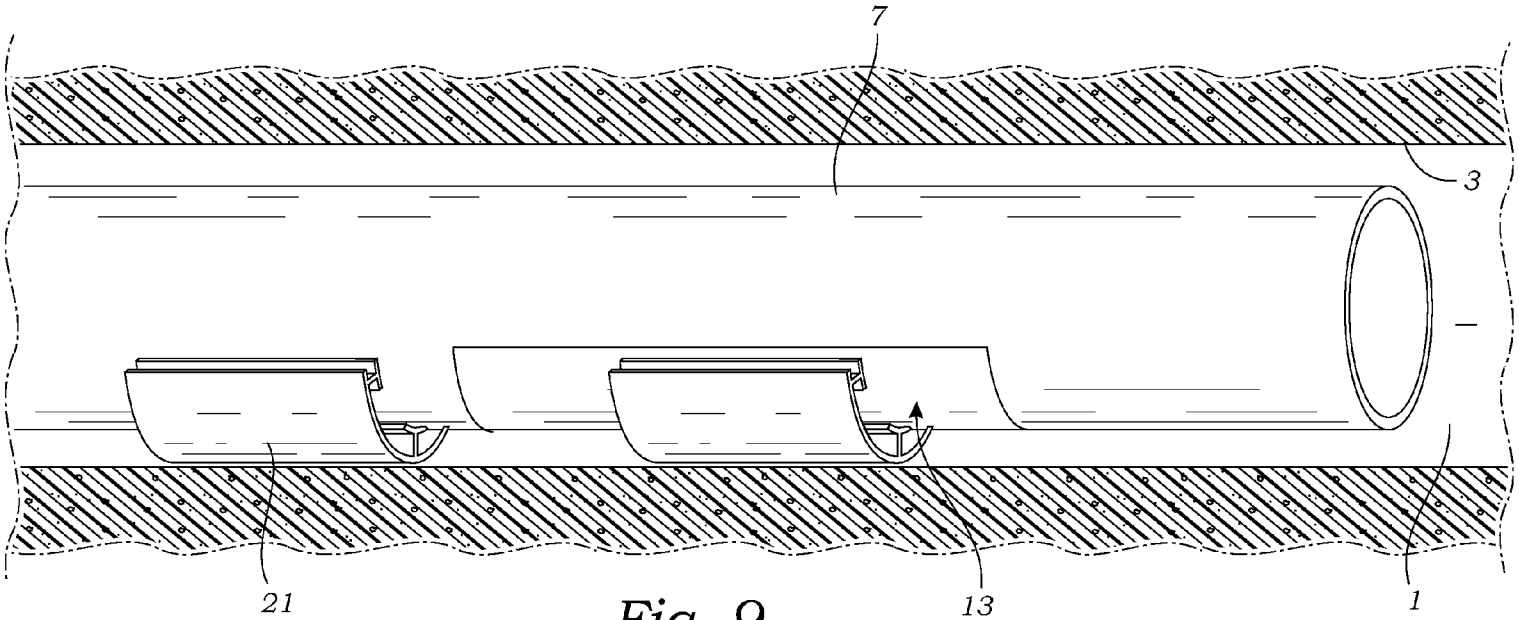
FIG. 9 is a side cut-away view of a wellbore illustrating an arcuate centralizer after being deployed from a pipe's sidewall opening.
Figure 11:
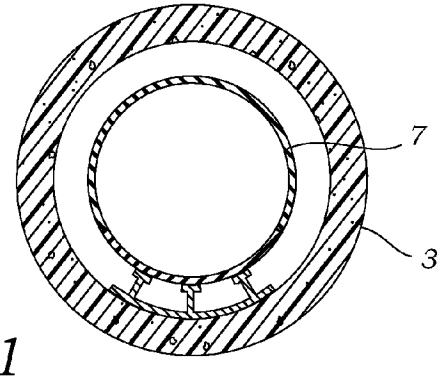
FIG. 11 is an end view of a wellbore illustrating an arcuate centralizer after being deployed from a pipe's sidewall opening.
Figure 10:
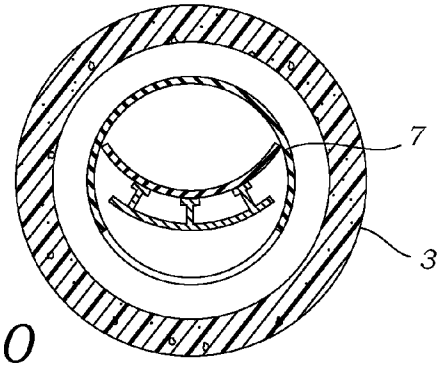
FIG. 10 is an end view of a wellbore illustrating an arcuate centralizer within a pipe/casing prior to being deployed from a pipe's sidewall opening.
Figure 12:
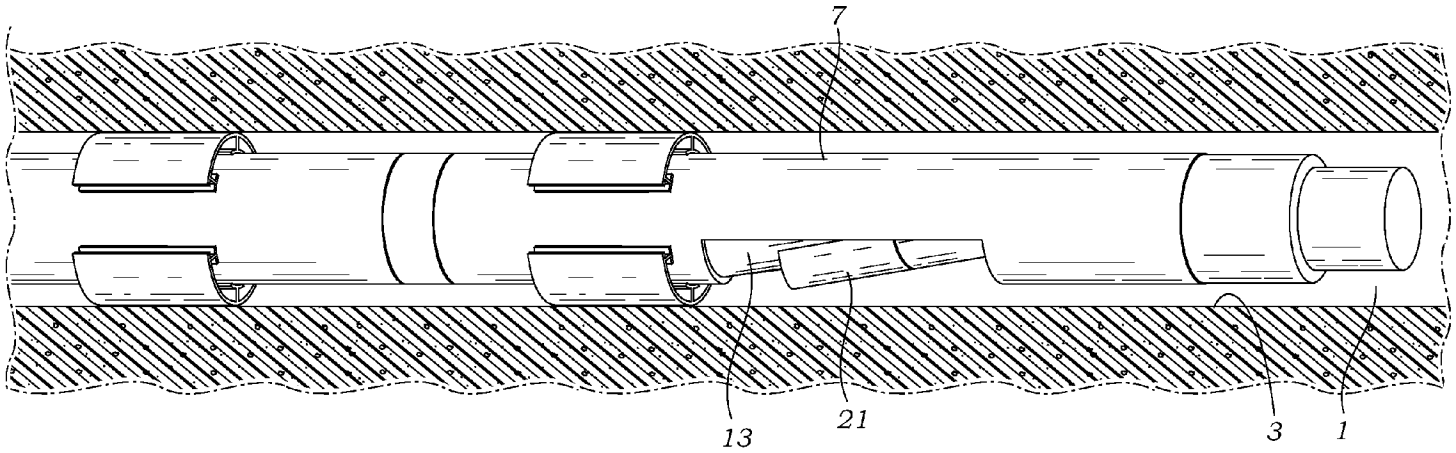
FIG. 12 is a side cut-away view of a wellbore illustrating two arcuate centralizers after being deployed from a pipe's sidewall opening and a third arcuate centralizer in the process of being deployed.

As described above, preferably the centralizer 21 has an annular construction. However, as illustrated in FIGS. 7-12, in less preferred embodiments, the centralizer 21 may have an arcuate construction. As illustrated in FIGS. 7 and 9, the arcuate centralizer 21 may be projected from the casing's interior from an opening, referred to as a portal 13, formed in the casing's sidewall. Preferably, the portal 13 has a ramp located within the casing's interior such that when the centralizer is forced downwardly through the portal 13, the centralizer 21 also deploys radially against the bore's sidewall 3. For this embodiment, preferably the casing 7 and portal 13 are rotatable within the wellbore 1 so that the centralizers 21 can be positioned in various locations around the casing, and not just at one arcuate position.

As illustrated in FIGS. 13 and 14, the arcuate centralizer 21 may be constructed with a small arc, thereby allowing the pipe's portal to be very small including only a small slot. Preferably, each arcuate centralizer, including those having a small arc, have a tapered inlet and low friction surface to allow entry and passage of a casing. The arcuate centralizers may also include sensors for detecting the wellbore's temperature, pressure and other environmental features.

While several particular forms of the invention have been illustrated and described, it will be apparent that various modifications can be made without departing from the spirit and scope of the invention. Therefore, it is not intended that the invention be limited to the specific embodiments illustrated. I described my invention in such terms as to enable a person skilled in the art to understand the invention, recreate the invention and practice it, and having presently identified the presently preferred embodiments thereof.

I claim:

1. A method of positioning casing centralizers downhole in a well comprising the steps of:

providing a well having a substantially circular sidewall, providing a pipe having a cylindrical sidewall, a central conduit, a distal extremity, and an opening at or near the pipe's distal extremity:

providing an at least partially circular structure having a central hole within the pipe central conduit;

positioning the pipe and the at least partially circular structure downhole with the at least partially circular structure positioned adjacent to a desired location for centralizing a well casing;

ejecting the at least partially circular structure from the interior of the pipe through the pipe opening so as to be positioned at the desired location for centralizing a well casing;

expanding the at least partially circular structure to be adjacent the wellbore sidewall at the desired location for centralizing a well casing; and moving a well casing downhole past the at least partially circular structure wherein the at least partially circular structure provides spacing between the well casing and the well sidewall.

2. The method of positioning casing centralizers downhole in a well of claim 1 wherein:

the at least partially circular structure is completely circular and radially expandable to form an expandable annular construction; and the expandable annular structure is ejected in the distal direction from an opening formed at the pipe's distal end.

3. The method of positioning casing centralizers downhole in a well of claim 1 wherein:

the at least partially circular structure is not completely circular and forms an arcuate construction; and the step of ejecting the at least partially circular structure from the interior of the pipe includes ejecting the arcuate construction in the radial direction from an opening formed in the pipe's sidewall.

4. The method of positioning casing centralizers downhole in a well of claim 1 wherein:

the pipe that ejects the at least partially circular structure and the well casing are one and the same; and after the pipe ejects the at least partially circular structure at the desired location, the pipe proceeds downhole for use as the well casing.

5. The method of positioning casing centralizers downhole in a well of claim 1 further comprising the step of:

ejecting a plurality of at least partially circular structures from the interior of the pipe through the pipe opening so as to be positioned at desired locations in the well bore for centralizing a well casing.

6. The method of positioning casing centralizers downhole in a well of claim 1 wherein:

the at least partially circular structure's central hole has a tapered inlet.

7. A method of positioning casing centralizers downhole in a well comprising the steps of:

providing a well having a substantially circular sidewall, providing a pipe having a cylindrical sidewall, a central conduit, a distal extremity, and a opening at or near the pipe's distal extremity:

providing an expandable annular construction with a central hole within the pipe central conduit;

positioning the pipe and the expandable annular structure downhole with the circular expandable structure positioned adjacent to a desired location for centralizing a well casing;

ejecting the expandable annular structure from the interior of the pipe through the pipe opening so as to be positioned at the desired location for centralizing a well casing;

expanding the expandable annular structure to engage the wellbore sidewall at the desired location for centralizing a well casing; and moving a well casing downhole past the expandable annular structure wherein the expandable annular structure provides spacing between the well casing and the well sidewall.

8. The method of positioning casing centralizers downhole in a well of claim 7 wherein:

the pipe that ejects the expandable annular structure and the well casing are one and the same; and after the pipe ejects the expandable annular structure at the desired location, the pipe proceeds downhole for use as the well casing.

9. The method of positioning casing centralizers downhole in a well of claim 7 wherein:

the expandable annular structure's central hole has a tapered inlet.

* * * * *